United States Patent [19]

Ohashi

[11] 4,063,055

[45] Dec. 13, 1977

[54] SWITCH WITH AN ON-OFF INDICATING MECHANISM

[76] Inventor: Shigeo Ohashi, 5-14 Minamimagome 1-chome, Ota, Tokyo, Japan

[21] Appl. No.: 676,434

[22] Filed: Apr. 13, 1976

[30] Foreign Application Priority Data

Apr. 16, 1975 Japan ..... 50-50372[U]

[51] Int. Cl.[2] ..... H01H 9/16

[52] U.S. Cl. ..... 200/308; 116/124 L

[58] Field of Search ..... 200/308, 309, 315, 310; 116/124 L

[56] References Cited

U.S. PATENT DOCUMENTS 3,930,135 12/1975 Kadaira ..... 200/308

*Primary Examiner*—Herman J. Hohauser

*Attorney, Agent, or Firm*—Lawrence I. Field

[57] ABSTRACT

A switch with an indicating mechanism having a movable indicating member which appears from and disappears in the upper end of a switch operating member to indicate the position of the switch, a receiving plate having an inclined surface on which the lower end of the operating member slides and being three-dimensionally disposed together with switch contact segments to effectively utilize the entire space inside.

11 Claims, 13 Drawing Figures

SWITCH WITH AN ON-OFF INDICATING MECHANISM

BRIEF SUMMARY OF THE INVENTION

The present invention relates to a switch and, more particularly, to a switch with an on-off indicating mechanism adapted to indicate the "ON" or "OFF" position by making the upper end of an on-off indicating member appear and disappear from the upper surface of an operating member.

Conventional means for identifying and indicating the position of a toggle switch or the like include those which indicate visually the position of an operating member, a handle or a button, and those which utilize an indicating lamp. In the case of an indicating lamp, it is rather expensive and tends to become off during operation, resulting in failure in and misunderstanding of the indication; and in addition, it is difficult to make the switch small, because special mechanisms, conductors, sockets, etc., must be installed.

In order to eliminate the above-mentioned disadvantages of the prior art, Yasuo Kodaira, Nihon Kaiheiki Industrial Co., Ltd., Tokyo, Japan, has made a study and devloped the following switch:

"A switch with an indicating mechanism which is visible or concealed, depending upon whether the switch is ON or OFF. The indicating mechanism is slidably mounted within a switch activator (e.g., a handle or actuator button). Inclined surfaces are provided in the switch housing and said indicating mechanism is spring biased against said surfaces, so that when the lower end of the movable member contacts the inclined surface in one position, the indicating mechanism remains concealed, indicating that the switch is OFF, and when in another position along the inclined surface, the spring causes the slidable indicating member to appear and thereby indicate that the switch is ON."

Detailed description of the above-mentioned switch will be found in the U.S. Pat. No. 3,930,135 granted on Dec. 30, 1975. However, in the above-mentioned switch, the inclined surface is provided substantially parallel with the movable contact segment installed at the bottom inside the switch, and therefore its width in the direction vertical to the operating direction of the operating member (the rocking direction of the movable contact segment), i.e., its interpolar width becomes large and, as a result, a standard switch housing bottom can not be utilized and standardization becomes difficult or, in other words, the bottom must be specially designed. Especially in the case of a switch having movable contact segments in odd numbers, for instance, one or three movable contact segments; its size tends to become great.

This invention has been made by Shigeo Ohashi, Nihon Kaiheiki Industrial Co., Ltd., Tokyo, Japan, and contemplates elimination of the above-mentioned inherent disadvantages of the prior art.

Therefore, it is an object of the present invention to provide a novel switch with an indicating mechanism which is inexpensive and can easily and correctly indicate the ON and OFF states.

It is another object of the present invention to provide a novel switch with an indicating mechanism which can be standardized according to the conventional standards.

It is still another object of the present invention to provide a novel switch with an indicating mechanism which has a construction capable of effectively utilizing the space therein and thereby can be made compact.

According to the present invention, there is provided a switch with an indicating mechanism comprising a laterally tiltable operating member, a switching member connected to the lower end of the operating member and operated by the operating member to switch movable contact segments provided on the internal bottom of a switch housing, an indicating member slidably inserted in a longitudinal through-hole provided in the operating member, a spring provided between the operating member and the indicating member, and a receiving plate provided above the switching member and having inclined surfaces, the lower end of the indicating member being laterally moved in response to the movement of the operating member while being vertically moved along the inclined surfaces by the action of the spring so that the upper end of the indicating member is made to appear from and disappear in the through-hole according to the position of the operating member.

BRIEF DESCRIPTION OF THE DRAWING

The above and other objects, features and advantages of the present invention will be more apparent from the following detailed description taken in conjunction with the accompanying drawings in which like reference numerals and characters designate corresponding parts throughout the views and in which.

DETAILED DESCRIPTION

Figure 1:
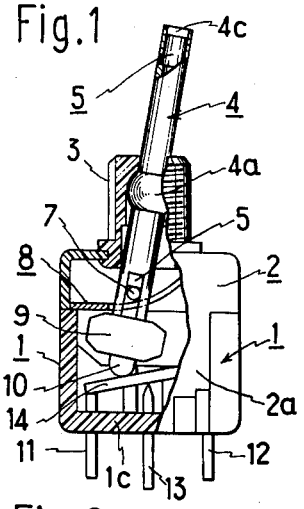
FIG. 1 is an elevational view partly in section of a switch with an on-off indicating member according to a preferred embodiment of the present invention.
Figure 3:
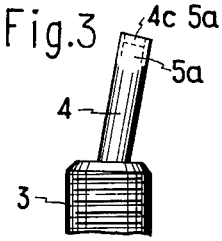
FIGS. 3 and 4 are schematic elevational views of the essential part of the switch according to the embodiment shown in FIG. 1, illustrating its two different positions, respectively, to explain the operation of the switch.
Figure 4:
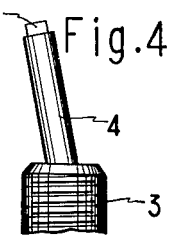

Reference is now made to FIGS. 1 to 7 which show a preferred embodiment of the present invention, especially to FIG. 1. Reference numeral 1 designates a switch housing, 2 a cover, 3 an externally threaded sleeve, and 4 a lever or a switch operating member. The cover 2 has, at the front and rear ends thereof, dependent portions 2*a* which are fitted in shallow recesses 1*a* (FIG. 6) provided on the front and rear surfaces of the housing 1. Each dependent portion 2*a* has, at the lower end thereof, tongues or the like which are folded and pressed into recesses 1*b* provided at the bottom of the housing 1 to fix the cover 12 to the housing 1. The sleeve 3 is fitted and fixed, at the bottom end thereof, to the central hole provided on the upper surface of the cover 2. The lever 4 has a bulged portion 4*a* which prevents the lever 4 from upwardly slipping off the sleeve 3 and about which the lever 4 is adapted to be tiltable laterally or to the right and left.

A switching member 9 is connected to the bottom of the lever 4. More particularly, the lever 4 is provided at the bottom end thereof with reduced-diameter projections 4*b* which are fitted in corresponding recesses provided on the upper surface of the switching member 9, and thereby the switching member 9 is interlocked with the lever 4 and is operated therewith. As a modified form, the switching member 9 may be provided at the upper surface thereof with projections which are fitted in corresponding recesses provided on the bottom surface of the lever 4, or may be formed integrally with the lever 4. The switching member 9 has, on the bottom surface thereof, recesses in each of which a slider 10 is fitted through a compression spring (not shown).

Figure 5:
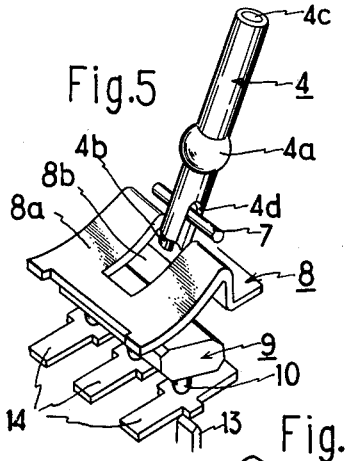
FIG. 5 is an exploded perspective view of the essential part of the switch according to the embodiment shown in FIG. 1.
Figure 2:
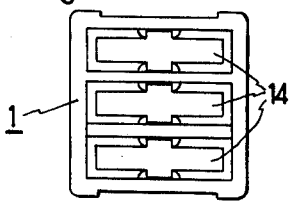
FIG. 2 is a plan view of the lower part of the switch according to the embodiment in FIG. 1.
Figure 6:
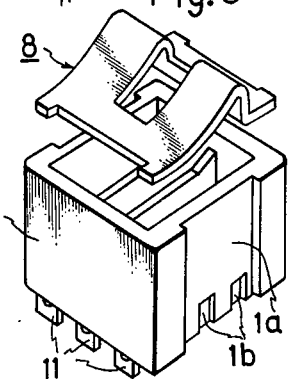
FIG. 6 is a perspective view of the housing, etc., of the switch according to the embodiment shown in FIG. 1.
Figure 7:
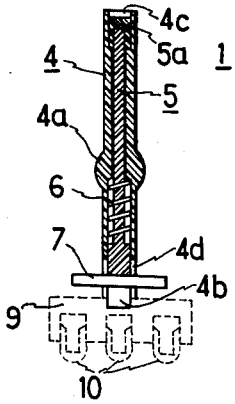
FIG. 7 is a longitudinal sectional view of the essential part of the switch according to the embodiment shown in FIG. 1.

Three vertical flat-plate fixed contact segments 11, 13 and 12, arranged from left to right in this order, are fixed to the housing 1 through the bottom wall 1*c* thereof. The lower end of each contact segment is also used as a terminal segment. The central fixed contact segment 13 has a knife-edge-shaped upper side, on which a horizontal flat-plate movable contact segment 14 is mounted so that it can be tilted laterally or to the right and left. These contact segments 11 to 14 constitute one set; and three sets of these contact segments are arranged side by side as shown in FIGS. 2, 5 and 6. Each of the sliders 10 is laterally movably mounted on the corresponding movable contact segment 14, and therefore the sliders 10 provided are three in number as shown in FIG. 7. Thus, in FIG. 1, the switching member 9 takes a shape long in the direction vertical to the paper surface.

The lever 4 has a longitudinal through-hole 4*c*, in which a rod-shaped indicating member 5 is longitudinally slidably inserted. As shown in FIG. 7, the indicating member 5 is provided at the lower portion thereof with a stepped portion having an upward-facing shoulder surface, and the through-hole 4*c* of the lever 4 is so formed that a downward-facing shoulder surface is provided therein at a position approximately corresponding to the bulged portion 4*a*; and a compression spring 6 is installed between these two shoulder surfaces. Accordingly, the indicating member 5 is at all times downwardly urged relative to the lever 4 by the action of the compression spring 6. An indicating element 5*a* is fixed to the upper end of the indicating member 5. As a modified form, the indicating element 5*a* may be formed integrally with the indicating member proper 5.

Front and rear longitudinal grooves 4*d* are formed at the lower portion of the lever 4. A pin 7 is vertically movably inserted in the grooves 4*d*. As shown, the lever 4 is substantially vertically arranged, while the pin 7 is arranged perpendicular to the lever 4 or horizontally. In this embodiment, the pin 7 is shown as formed separately from the indicating member 5. However, it may be formed integrally with the indicating member 5.

As shown in FIGS. 1 and 6, a receiving plate 8 for receiving the pin 7 from thereunder is mounted on the peripheral upper surface of the cover 2. The receiving plate 8 has a laterally inclined surface 8*a* occupying most of its area and having a central rectangular hole 8*b* for freely passing the lower part of the the lever 4. The width of the rectangular hole 8*b* is smaller than the length of the pin 7, and therefore the pin 7 can be received by the inclined surface 8*a*. Thus, the pin 7 tends to be lowered by the action of the spring 6 through the indicating member 5 as shown in FIG. 7, but its further downward movement is prevented because the both ends thereof abut against the inclined surface 8*a* of the receiving plate 8. Accordingly, the indicating member 5 assumes a lowered position when the pin 7 is at a lower position of the inclined surface 8*a*, and is pushed up to an elevated position against the action of the spring 6 when the lever 4 is tilted towards the opposite direction to upwardly move the pin 7 along the inclined surface 8*a*. The indicating element 5*a* positioned at the upper end of the indicating member 5 is adapted so that it disappears from the upper end of the lever 4 when the lever 4 assumes a position shown in FIG. 1 or FIG. 3 and so that it appears from the upper end of the lever 4 when the lever 4 assumes another position shown in FIG. 4. Thus, the indicating element 5*a* can indicate the states of the switch, such as "ON" and "OFF" states.

Figure 8:
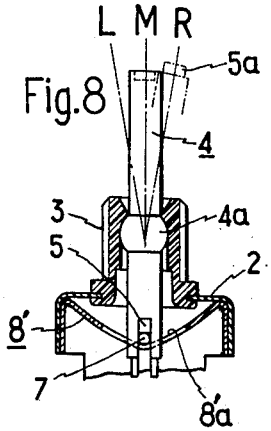
FIG. 8 is a longitudinal sectional view of the essential part of the switch according to a modified form of the embodiment shown in FIG. 1.

In the above-mentioned embodiment, the lever 4 is shown as having two right and left stable positions. However, as a modified form of this embodiment, a three-position switch may be provided in which the lever 4 has three stable or working positions, that is, a middle stable position M in addition to right and left stable positions R and L as shown in FIG. 8; and in this case, the inclined surface 8'*a* of the receiving plate 8' is made to be laterally symmetric with respect to its central lowered portion.

In addition, various modifications of the receiving plate 8 for forming the inclined surface are possible as a matter of course. For instance, inclined surfaces may be provided on the upper surfaces of the vertical front and rear (when viewed in FIG. 1) members of a vertical plate frame U-shaped when viewed from the above; and the front and rear ends of the pin 7 may be mounted on these inclined surfaces, respectively. In another modified form, inclined surfaces may be provided on the inside surfaces of the short upward extensions of the front and rear walls of the housing 1; and the front and rear ends of the pin 7 may be mounted on these inclined surfaces, respectively. In a further modified form, inclined holes or internal recesses may be provided on the upper sides of the front and rear walls of the cover 2; and the front and rear ends of the pin 7 may be inserted in or mounted on these holes or recesses, respectively.

In the above-mentioned embodiment, the spring 6 is shown in as disposed under the central bulged portion 4*a* of the lever 4 as illustrated in FIG. 7. However, the spring 6 may be disposed above the bulged portion 4*a*, for instance, under and in the vicinity of the indicating element 5*a* so that it may urge the indicating member 5 downwardly. In another modified form, the spring 6 may be so disposed that it can urge the indicating member upwardly; and in this case, the spring 6 may be inserted, for instance, between the bottom surface of the indicating element 5*a* and the upward-facing shoulder surface provided in the lever 4, and the pin 7 may be provided on the upper end of the indicating member and the both ends thereof may be disposed under the inclined surface thereby to restrict the upward movement of the pin 7; and the indicating element 5*a* is adapted so that it may disappear from the upper end of the lever 4 when the pin 7 is held by the lowest portion of the inclined surface and so that it may appear from the upper end of the lever 4 when the pin 7 is held by the higher portion of the inclined surface.

Figure 9:
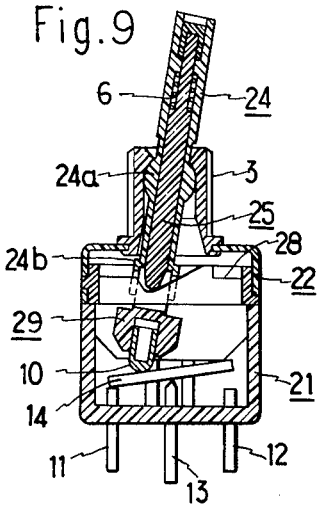
FIG. 9 is a longitudinal sectional view of a switch according to another preferred embodiment of the present invention.
Figure 10:
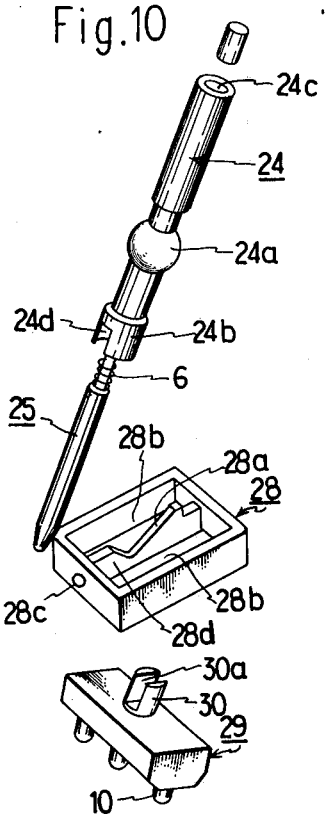
FIG. 10 is an exploded perspective view of the essential part of the switch according to the embodiment shown in FIG. 9.

Reference is now made to FIGS. 9 and 10 which show the second embodiment of the present invention. Reference numeral 21 designates a switch housing, and numeral 22 illustrates a cover. A receiving plate 28 is provided between the housing 21 and the cover 22. An inclined surface 28*a* is formed on the central portion of the receiving plate 28. Holes 28*b* are provided at both sides of the inclined surface 28*a*. Numeral 24 designates an operating member having a central bulged portion 24*a* as in the case of the first embodiment. The operating member 24 is provided with a longitudinal through-hole 24*c*, in which a long rod-shaped indicating member 25 is longitudinally slidably inserted and in which a spring 6 is also inserted between the shoulder portions provided on the operating member 24 and the indicating member 25. Thus, the indicating member 25 is at all times urged downwardly with respect to the operating member 24 by the action of the spring 6. At the lower end of the operating member 24, a connecting member 24*b* with a longitudinal groove 24*d* is provided so that it may straddle the central portion 28*d* of the receiving plate 28 and may be connected to the switching member 29.

The connecting member 29 is operatively connected to the movable contact segments 14 through spring-biased sliders 10. And its upper surface is provided at its central portion with a fitting member 30 suitable for connection with the connecting member 24*b* of the operating member 24. The recess 30*a* of the fitting member 30 straddles the inclined-surface-bearing central portion 28*d* of the receiving plate 28, and the connecting member 24*b* of the operating member 24 is fitted to the fitting member 30. As shown in FIG. 9. The operating member 24, indicating member 25, receiving plate 28 and switching member 29 are incorporated in the switch housing 21 and the cover 22. Thus, the rocking motion of the operating member 24 causes the slider 10 to slide on the movable contact segment 14 and simultaneously causes the bottom end of the indicating member 25 to slide on the inclined surface 28*a* and, as a result, the upper end of the indicating member 25 appears or disappears from the upper end of the operating member thereby showing the "ON" or "OFF" state of the switch. Numeral 28*c* designates a projection which is fitted to the hole of the cover 22. In the drawings with respect to the first and second embodiments, like reference numerals designate corresponding parts.

Figure 11:
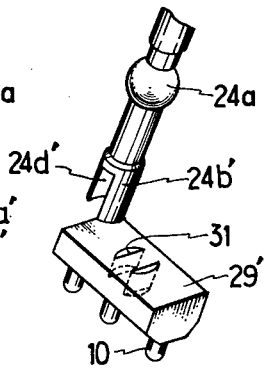
FIG. 11 is a perspective view of a switch according to the first modified form of the embodiment shown in FIG. 9.

FIG. 11 shows the essential part of the second embodiment, illustrating a modified form of means for connecting the operating member 24 to the switching member 29'. The switching member 29' is provided with recesses 31, in which fitted are the ends of the connecting member 24*b'* of the operating member 24 having a longitudinal groove 24*d'* longer than that in the case of the first embodiment. Therefore, in this modification, only the connecting member 24*b'* comes to straddle the inclined-surface-bearing portion 28*b*.

Figure 12:
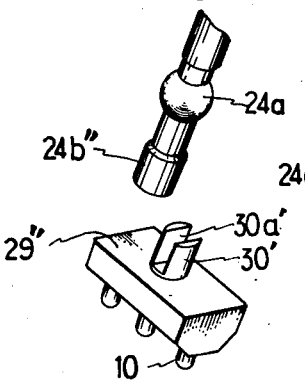
FIG. 12 is a perspective view of a switch according to the second modified form of the embodiment shown in FIG. 9.

FIG. 12 shows a further modified form of the second embodiment. The switching member 29'' is provided with a fitting member 30' having a recess 30*a'* longer than that in the case of the above-mentioned second embodiment. A connecting member 24*b''* with no longitudinal groove is fitted to the leading end of the fitting member 30'. Accordingly, in this modified form, only the fitting member 30' straddles the inclined-surface-bearing portion 28*d*.

Figure 13:
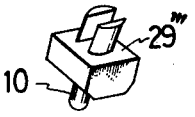
FIG. 13 is a perspective view showing an example of the bottom surface of the switch proper according to the present invention.

FIG. 13 shows an example of the switching member of a monopolar switch. As seen especially in the case of the odd-number-polar switches such as monopolar switches and tripolar switches showing in the second embodiment, the switching member can be decreased in the width vertical to the rocking direction of the movable contact segment, since the inclined surface is not provided parallel with the movable contact unlike the prior art.

As is apparent from the foregoing description, the switch according to the present invention has no danger of failure in or misunderstanding of the indication due to broken wires, etc., and simple in construction, since it has no indicating lamp for indicating the "ON" and "OFF" states of the switch. It requires no particularly large installation area, for instance, on the panel surface or the printed board surface in spite of provision of an on-off indicating mechanism and therefore can be made relatively small in size, since the inclined surface portion for use in indication is provided above the switching member. Especially in the case of a multiple switch such as a monopolar or tripolar switch; a conventional switch, in which the inclined surface for indication is provided on the internal bottom of the switch housing, has disadvantages in that it requires an additional floor space for the inclined surface and therefore becomes large in size accordingly; whereas the switch according to the present invention can eliminate the above-mentioned disadvantages, and also the conventional parts can be utilized for the contact mechanism of the switch or for the external terminal segments irrespective of whether or not the indicating member is provided, and therefore can be standardized.

According to the present invention, the position of the switch can be more clearly indicated by the colored upper end of the indicating member compared with the case where only the operating member is employed.

What is claimed is:

1. In a switch, an open top switch housing, a cover having depending walls seated on said switch housing, and an indicating mechanism comprising:

a laterally tiltable actuating member having a longitudinally extending bore, said actuating member being disposed with its lower end in said housing and its upper end extending through an aperture in said cover;

a movable indicating member slidably received in said bore;

a switching member connected to the lower end of said actuating member and carried by said actuating member to switch movable contact segments into contact with contact segments fixed to said switch housing and extending through the bottom of said switch housing;

a receiving plate disposed above said switch housing and received within the volume defined by said depending walls, said receiving plate having an inclined surface and being located above said switching member, supported on said housing and within said cover;

a spring inserted between said actuating member and said indicating member;

a longitudinal groove formed at the lower portion of said indicating member; and a vertically movable pin provided adjacent to the lower end of said indicating member, adapted to be pressed against said inclined surface by the action of said spring;

whereby the upper end of said indicating member is made to be selectively visible or concealed by extending out of or being recessed within the upper surface of the actuator in accordance with the operating position of said actuating member.

2. A switch with an indicating mechanism as set forth in claim 1, wherein said receiving plate is provided at the central portion of said inclined surface thereof with a rectangular hole for freely passing the lower portion of said actuating member.

3. A switch with an indicating mechanism as set forth in claim 1, wherein said actuating member is provided at its lower portion with a reduced-diameter portion and wherein said reduced-diameter portion is fitted in a recess formed on the upper surface of said switching member thereby operatively connecting said actuating member to said switching member.

4. A switch with an indicating mechanism as set forth in claim 1, wherein said actuating member is provided at the lower portion thereof with a recess and wherein said recess is fitted to a projection formed on the upper surface of said switching member thereby operatively connecting said actuating member to said switching member.

5. A switch with an indicating mechanism as set forth in claim 1, wherein said actuating member is in contact with said lateral pin at the lower end thereof.

6. A switch with an indicating mechanism as set forth in claim 1, wherein the lower end portion of said actuating member is formed integrally with said lateral pin.

7. A switch with an indicating mechanism as set forth in claim 1, wherein said inclined surface of said receiving plate is laterally symmetrical with the lowest portion at the center.

8. In a switch, an open top switch housing, a cover having depending walls seated on said switch housing, and an indicating mechanism comprising:

a laterally tiltable actuating member having a longitudinally extending bore, said actuating member being disposed with its lower end in said housing and its upper end extending through an aperture in said cover;

a movable indicating member slidably received in said bore;

a switching member connected to the lower end of said actuating member and carried by said actuating member to switch movable contact segments into contact segments fixed to said switch housing and extending through the bottom of said switch housing;

a spring inserted between said actuating member and said indicating member;

a receiving plate having an inclined surface at the center thereof and located above said switching member, said spring urging the lower end of said indicating member to make contact with and move along said inclined surface, said receiving plate being supported on said housing and within said cover;

a connecting member disposed at the lower end of said actuating member, said connecting member being constructed to straddle said receiving plate and means connecting the lower end of said connecting member to said switching member;

whereby the upper end of the indicating member is made to be selectively visible or concealed by extending out of or being recessed within the upper surface of the actuator in accordance with the operating position of said actuating member.

9. A switch with an indicating mechanism as set forth in claim 8, wherein the lower end portion of said indicating member is slidably in contact with the inclined surface of said receiving plate, a fitting member provided at the upper portion of said switching member straddles the inclined-surface-bearing portion, and a connecting member having a longitudinal groove and provided at the lower end portion of said actuating member is fitted onto said inclined surface portion.

10. A switch with an indicating mechanism as set forth in claim 8, wherein the longitudinal groove of said connecting member provided at the end of said actuating member is formed relatively long, said connecting member is made to straddle the inclined-surface-bearing portion of said receiving plate, and the leading end of said connecting member is fitted in a recess provided on the switching member.

11. A switch with an indicating mechanism as set forth in claim 8, wherein a fitting member having a relatively long recess and formed on the upper surface of said switching member straddles said inclined-surface-bearing portion, and the leading end of said fitting member is fitted in a recess of a connecting member provided at the lower end portion of said actuating member.

* * * * *